United States Patent [19]

Engelson

[11] 4,447,913

[45] May 15, 1984

[54] BELT

[75] Inventor: David Engelson, Roslyn, N.Y.

[73] Assignee: Page Accessories, Inc., West Babylon, N.Y.

[21] Appl. No.: 400,607

[22] Filed: Jul. 22, 1982

[51] Int. Cl.[3] ..... A41F 3/02

[52] U.S. Cl. ..... 2/338; 2/339; D2/380

[58] Field of Search ..... 2/338, 321, 312, 311, 2/339; D2/380, 387, 393

[56] References Cited

U.S. PATENT DOCUMENTS

| | | | |
|---|---|---|---|
| 389,660 | 9/1888 | Mandel et al. | 411/457 |
| 784,891 | 3/1905 | Saart | 2/321 |
| 2,128,730 | 8/1938 | Murphy | 411/457 |

FOREIGN PATENT DOCUMENTS

| | | | |
|---|---|---|---|
| 65923 | 3/1943 | Norway | 2/338 |

*Primary Examiner*—Doris L. Troutman

[57] ABSTRACT

A belt having a stretchable substrate and fish-scale type plates attached to the substrate by stapler-like elements.

1 Claim, 6 Drawing Figures

BELT

BACKGROUND OF THE INVENTION

The invention relates to a belt, and more specifically to a belt for a lady's garment, of the type having a number of fish-scale type plates attached thereto. More specifically, the invention relates to a belt of this type which is stretchable and which has novel means of attaching the plates to a stretchable support or substrate.

BRIEF DESCRIPTION OF THE DRAWINGS

The invention is illustrated, by way of example, in the attached drawings, in which.

DETAILED DESCRIPTION OF A PREFERRED EMBODIMENT

Figure 1:
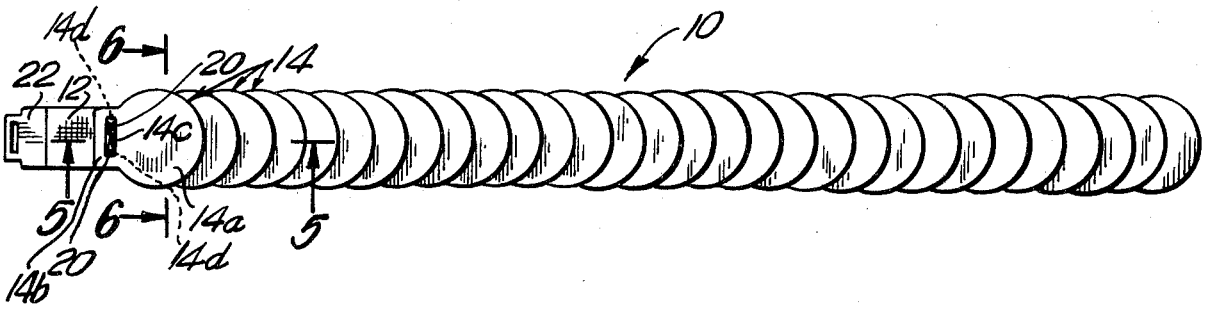
FIG. 1 is a top view of the belt according to the invention.

The belt designated as a whole by the reference numeral 10 comprises a stretchable substrate or support belt 12 of fabric. The substrate 12 is stretchable in longitudinal direction and can be rolled and bent and flexed in all directions. A wide variety of materials for this purpose are available, and well known in the art.

Figure 2:
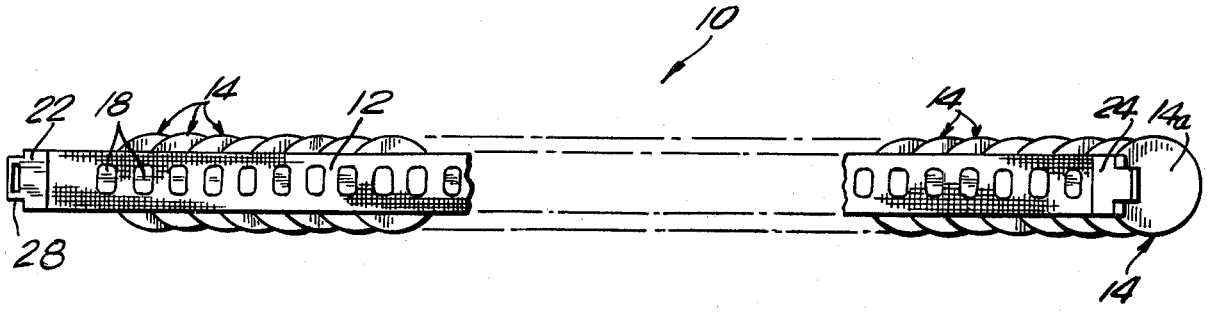
FIG. 2 is a bottom view of the belt of FIG. 1.
Figure 3:
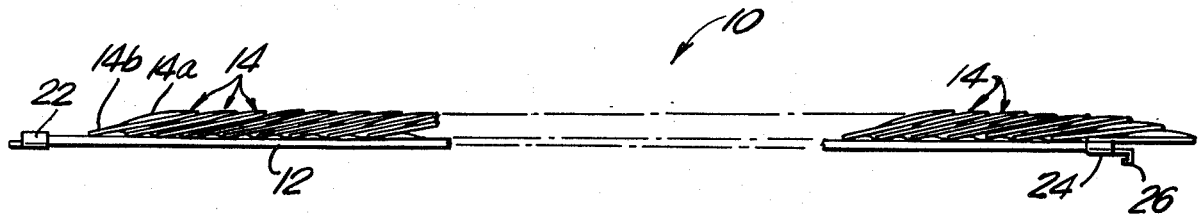
FIG. 3 is a side view of the belt of FIG. 1.
Figure 4:
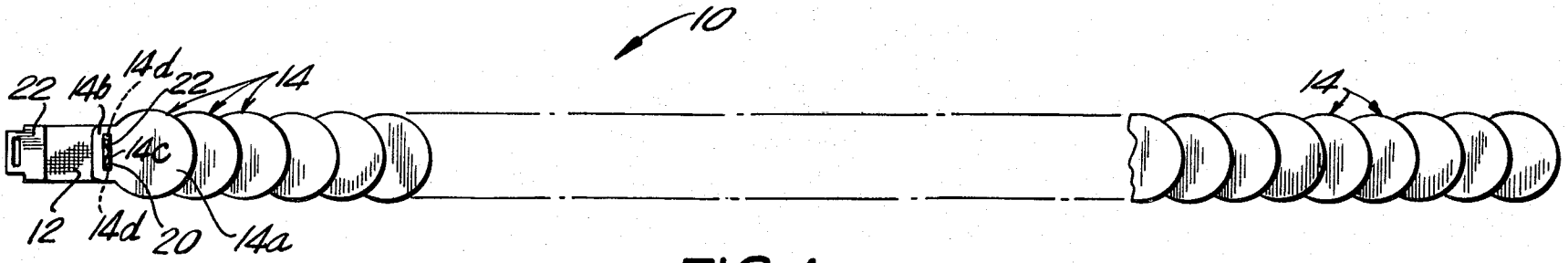
FIG. 4 is a top view of a portion of the belt of FIG. 1, but in stretched condition.
Figure 6:
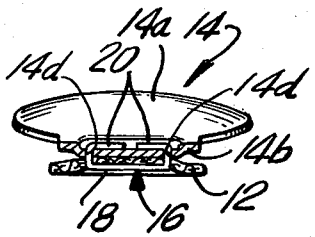
FIG. 6 is a cross section taken along the line 6—6 of FIG. 1.
Figure 5:
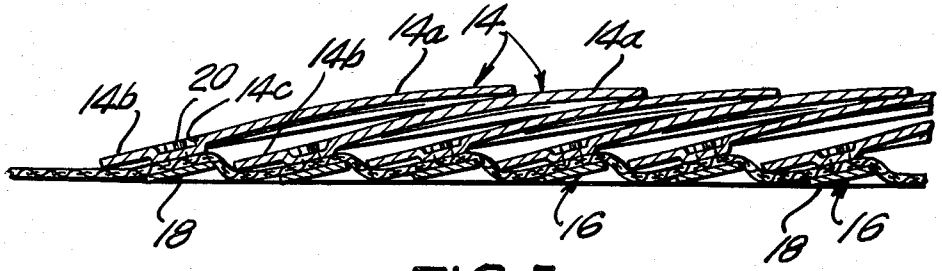
FIG. 5 is a longitudinal section through a portion of the belt of FIG. 1, as taken along line 5—5 of FIG. 1.

A plurality of partially overlapping plates 14 cover one side of substrate 12. Each plate 14 has an essentially circular portion **14*a* and an extension 14*b* of essentially rectangular form. Portion 14*b* has an essentially rectangular depression 14*c* and a pair of holes 14*d* at opposite ends of depression 14*c*. Fastening elements 16 connect the plates 14 to the substrate 12. Each connecting element 16 has a relatively broad base 18 (see FIGS. 2, 5 and 6) and two relatively narrow extensions 20 connected to opposite ends of the base 18. These extensions extend through the substrate 12 and the holes 14*d* and are bent towards each other as shown in FIGS. 1 and 6 to thereby fixedly connect the respective plate to the substrate 12**.

The plates 14 may be made of a variety of materials, such as aluminum, plated steel or the like. In customary manner the belt substrate 12 is provided with a buckle 22, 24. Thus, once the belt has been placed around a person's waist, a hook 26 of buckle portion 24 may be hooked to buckle portion 22 after being passed through an opening 28 therein.

While a preferred embodiment of the invention has been described above, it is of course to be understood that various modifications may be made within the scope of the appended claims without departing from the spirit of the invention.

I claim:

1. A belt comprising: an elongated substrate of a stretchable material, a plurality of plates partially overlapping each other on one side of said substrate, and a plurality of connecting means respectively connecting said plurality of plates to said substrate, each of said connecting means having a base on the other side of said substrate, and spaced prongs connected to said base and extending through said substrate and through openings in the respective plate and being bent to lie essentially parallel to said plate to thereby fixedly connect said plate to said substrate, wherein each of said plates has an essentially circular portion and an essentially rectangular portion extending from said essentially circular portion, said openings being provided in said rectangular portion.

* * * * *